United States Patent [19]

Fujitani

[11] Patent Number: 4,561,184

[45] Date of Patent: Dec. 31, 1985

[54] SCHOOL UTENSIL AND TOY ROBOT

[75] Inventor: Takashi Fujitani, Tokyo, Japan

[73] Assignee: Kabushiki Kaisha Gakushu Kenkyusha, Tokyo, Japan

[21] Appl. No.: 530,263

[22] Filed: Sep. 8, 1983

[30] Foreign Application Priority Data

Apr. 28, 1983 [JP] Japan ..... 58-64301

[51] Int. Cl.[4] ..... A63H 3/00; B43L 9/00; B43K 24/02

[52] U.S. Cl. ..... 33/27.02; 33/152 B; 446/72; 446/146; 446/376; 446/390; 401/109

[58] Field of Search ..... 446/146, 71, 72; 33/27 B, 149 R, 27 F, 148 E, 27 R, 148 C, 152 B; D19/38, 42; 401/195, 31, 109

[56] References Cited

U.S. PATENT DOCUMENTS

| | | | |
|---|---|---|---|
| D. 51,931 | 4/1918 | Morten | D19/42 |
| D. 271,590 | 11/1983 | Ashcroft | D19/38 |
| 1,199,155 | 9/1916 | Burriss | 33/148 E |
| 1,451,628 | 4/1923 | Nakian | 446/72 |
| 1,479,598 | 1/1924 | Garcia | 33/148 E |
| 1,644,221 | 10/1927 | Angeletti | 33/148 E |
| 1,921,892 | 8/1933 | Sommer | 33/27 R |
| 1,998,352 | 4/1935 | Bachmann | 33/153 F |
| 2,380,175 | 7/1945 | Hawkey | 446/72 |
| 2,563,309 | 8/1951 | Collins | 33/27 B |
| 2,928,180 | 3/1960 | Duke | 33/27 B |
| 3,628,251 | 12/1971 | Feldl | 33/27 B |
| 4,468,146 | 8/1984 | Tabachnik | D19/42 |

FOREIGN PATENT DOCUMENTS

| | | | |
|---|---|---|---|
| 984259 | 2/1951 | France | 33/27 B |
| 1099578 | 3/1955 | France | 33/27 B |
| 50-31077 | 9/1975 | Japan . | |
| 53-51236 | 12/1978 | Japan . | |
| 54-105645 | 7/1979 | Japan . | |
| 57-128491 | 8/1982 | Japan . | |
| 57-149193 | 9/1982 | Japan . | |
| 134982 | 3/1952 | Sweden | 33/149 R |

*Primary Examiner*—F. Barry Shay

*Attorney, Agent, or Firm*—Hall, Myers & Rose

[57] ABSTRACT

A school utensil and toy is provided which includes a support member, two leg members rotatably connected to the support member and two foot members rotatably connected to the leg members. At least one of the foot members includes an ink pen which can be retracted into the foot member when not in use. The school utensil and toy also includes members having features that are esthetically pleasing to children such that children will be enticed to play with the utensil and toy. These features may include rotatable arms and a head member. The school utensil and toy can be employed either as a compass, divider, ball point pen or as a toy having two legs such as a robot or a doll.

15 Claims, 8 Drawing Figures

SCHOOL UTENSIL AND TOY ROBOT

BACKGROUND OF THE INVENTION

1. Field of the Invention:

This invention relates to school utensils. More particularly, this invention relates to school utensils which have features that entice children to use the utensils as toys.

2. Description of the Prior Art

School utensils, such as compasses and ball-point pens, are designed to be purely functional so that they have a flat and uninspiring shape, i.e. a totally uninteresting shape unappealing to children. Therefore, many young children lose interest in using school utensils such as writing implements, and come to dislike studying.

The present invention has been developed with a view to solving these problems with school utensils.

SUMMARY OF THE INVENTION

The present invention provides a school utensil and toy robot comprising a support constituting a nucleus of a robot body and including a base portion and a rod portion extending upward from the base portion, a head member fixed onto the upper end of the rod portion, a trunk member joined to the rod portion of the support so as to surround the same, a pair of arm members joined to the trunk member, a shaft provided in the base portion of the support so as to extend perpendicular thereto, a pair of leg members fitted by their upper end portions around the shaft, and a writing means provided at the lower end portion of at least one of the two leg members. The writing means may consist of a ball-point pen.

An object of the present invention is to provide a school utensil which can be used as a compass and a ball-point pen, and also played with as a toy.

A preferred embodiment of the present invention will be described in detail later with reference to the accompanying drawings, and the above and other features, objects and advantages of the invention will become apparent therefrom.

DETAILED DESCRIPTION OF THE DRAWINGS

Figure 1:
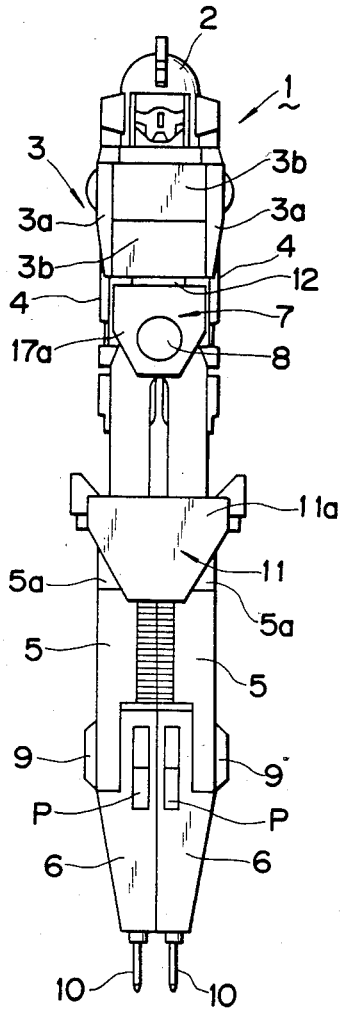
FIG. 1 is a front elevation view of one embodiment of this invention.
Figure 2:
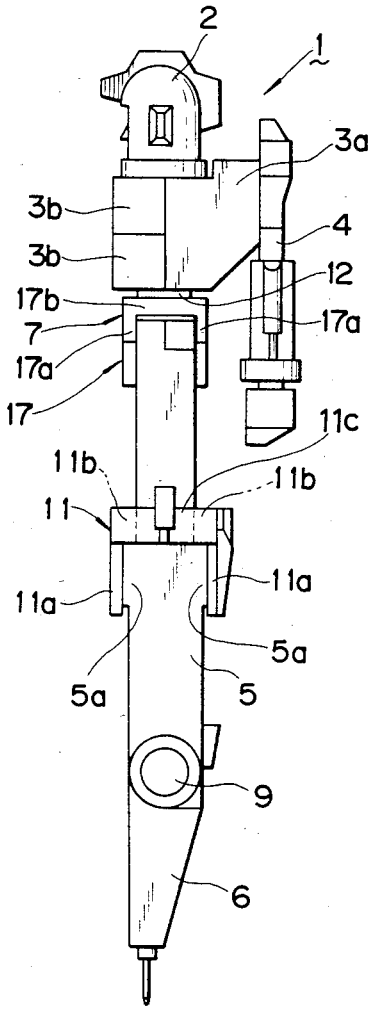
FIG. 2 is a side elevation view of the embodiment of this invention illustrated in FIG. 1.
Figure 3:
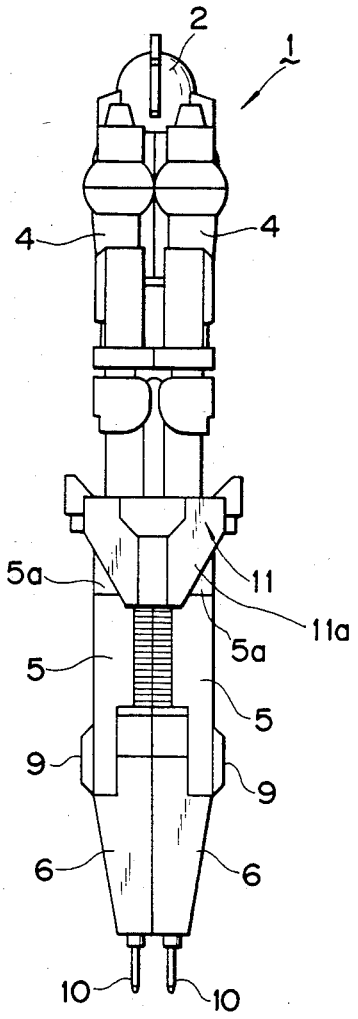
FIG. 3 is a rear elevation view of the embodiment of this invention illustrated in FIGS. 1 and 2.

Referring to FIGS. 1–3, an embodiment of this invention is illustrated, school utensil and toy robot, 1, having head member 2, trunk member 3, arm members 4, leg members 5, and foot members 6, all of said parts being assembled about support 7 which is the nucleus of school utensil and toy robot 1.

Support 7 includes a base consisting of front and rear parallel vertical plates 17*a*, a horizontal plate 17*b* connecting the upper ends of the vertical plates 17*a* and a rod extending upwardly therefrom. Thus, support 7 has a lower portion 17, comprised of plates 17*a* and 17*b*, which has a longitudinal cross-section in the shape of a channel, with the flanges of the channel extending downward.

Shaft 8 is provided between the vertical plates 17*a* so as to extend perpendicularly therebetween. The right and left leg members 5, which are normally positioned adjacent to each other in the same plane, are rotatably mounted by their upper end portions onto the shaft 8 with the upper end portions of the leg members 5 staggered on the shaft 8 in the lengthwise direction thereof. Each of these two leg members 5 is adapted to move pivotally around the shaft 8 to the right or left.

Figure 4:
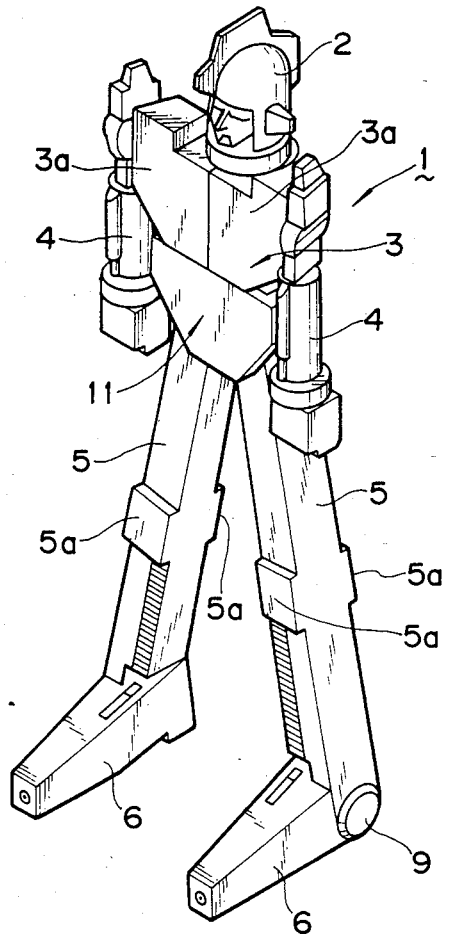
FIG. 4 is a perspective view of the embodiment of this invention illustrated in FIGS. 1–3, standing with its leg members apart.

Each of the foot members 6 is rotatably connected to a leg member 5 by a laterally extending pin 9 in such a manner that each foot member 6 can be turned clockwise from the position shown in FIGS. 1–3 up to a position 90° from that position, as shown in FIG. 4.

Each of the foot members 6 houses a ball-point pen assembly including a ball-point pen 10 and cam piece P, in such a manner that each ball-point pen 10 can be projected from its foot member 6. The ball-point pens 10 in FIGS. 1–3 are shown projected, i.e. they are ready for use.

This embodiment includes member 11 for restricting the opening and closing of the leg members 5. Restriction member 11 has two thru holes therein (not shown) which extend the height of member 11 and slidably engage leg members 5, such that member 11 can be slid up and down leg members 5 within the limitations discussed below. Restriction member 11 includes front and rear flat plates 11*a* connected together at the upper end portions thereof by side plates 11*c*, and locking projections 11*b* (shown in FIG. 2) which are blocks extending inward from both inner surfaces of the upper portions of plates 11*a*. Restriction member 11 is open at its upper and lower ends and is also designed to encompass support 7 when restriction member 11 is in its upper position.

Forward and rearward extending projections 5*a* are formed on intermediate portions of the front and rear surfaces of the leg members 5 (see FIG. 2). When the restriction member 11 is lowered while the leg members 5 are kept closed, as shown in FIGS. 1–3, i.e., while leg members 5 are kept in abutment, the inner projections ll*b* of restriction member 11 are brought into engagement with the projections 5*a* on the leg members 5. When restriction member 11 is in this position, as shown in FIGS. 1–3, leg members 5 are held in the closed or abutting position and can not be opened until restriction member 11 is raised. When the restriction member 11 is moved upward so that it fits around the support 7 in such a manner that the support 7 is held by the restriction member 11, leg members 5 can then be moved pivotally around shaft 8.

Rod 12 is attached to horizontal plate 17*b* and extends upwardly therefrom. Trunk member 3 of school utensil and toy robot 1 is comprised of right and left matching members 3*a* which include annular fitting portions 3*b* (each member 3*a* having one such portion). Annular portions 3*b* receive rod 12 and are positioned one above the other on rod 12. Rod 12 also has head member 2 fixedly attached at the upper end thereof. The right and left matching members 3*a*, except the annular portions 3*b* thereof, are formed symmetrically with each other. The arm members 4 are suspended from outer end surfaces of the matching members 3*a*. This arrangement at elements allows a child playing with the toy to swing the robot's arms.

FIGS. 1–3 show the school utensil and toy robot 1 with the matching members 3*a* rotated to the rear side thereof so that the arm members 4 are positioned to the rear, and with the restriction member 11 in its lowermost position holding leg members 5 together. Namely, these drawings show school utensil and toy robot 1 in its most compactly folded state, except for the ball-point pens 10 which are projecting out feet members 6.

The retracted position and method of retracting the ball-point pens 10, which are in the extended position ready for use in the embodiment shown in FIGS. 1–3, will be explained later.

A method of using school utensil and toy robot 1 as a compass or a ball-point pen will now be described in detail.

In order to use school utensil and toy robot 1 as a compass, the matching members 3*a* of the trunk member 3 are rotated to the rear to position the arm members 4 on the same side, as shown in FIGS. 1–3, thereby rendering the robot body easy to be held in one hand. The restriction member 11 is then slid upward so that it fits around the support 7. As a result, the leg members 5 become able to move pivotally. The leg members 5 are then opened to the right and left to the desired angle. When the head member 2 is then held by the hand so that one ball-point pen 10 can be rotated while the other is fixed as a fulcrum, a circle or arc can be drawn. It is preferable to hold the fulcrum ball-point pen at at a suitable position with the other hand during this time.

In order to use school utensil and toy robot 1 as a single ball-point pen, one of the ball-point pens can be retracted into its corresponding foot member 6. The user then grips school utensil and toy robot 1 in any convenient manner for writing.

To convert school utensil and toy robot 1 from a compass or a ball-point pen to a toy robot, both the ball-point pens 10 are retracted into the foot members 6, which are then rotated forward 90° around the pins 9, and the matching members 3*a* are rotated forward around the rod 12 to bring them into contact with each other (as shown in FIG. 4). The embodiment as a whole then takes on the shape of a robot and is able to stand on a horizontal surface since the back (now bottom) surfaces of feet members 6 are either flat or shaped as a sole of a shoe.

A mechanism and method of retracting the ball-point pens 10 will now be described with reference to FIGS. 5, 6*a*, 6*b* and 7.

Figure 5:
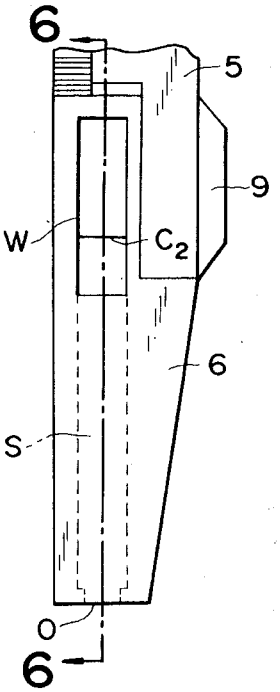
FIG. 5 is an enlarged view of the left leg member of the embodiment of this invention illustrated in FIGS. 1–4, with the ball-point pen not shown.
Figure 7:
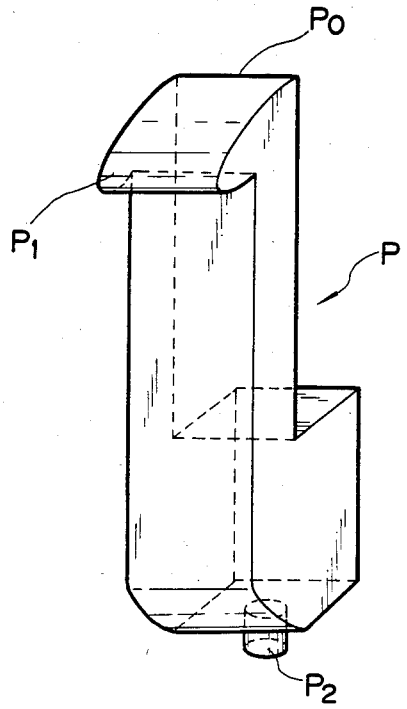
FIG. 7 is a perspective view of a cam piece for the ball-point pen illustrated in FIGS. 6*a* and 6*b*.

Referring to FIG. 5, openings W are formed in the front portions of foot members 6, communicating via internal spaces S with openings O formed in the bottom portion of foot members 6. Cams $C_2$ are formed on inner surfaces of the rear portions of the foot members 6.

Figure 6B:
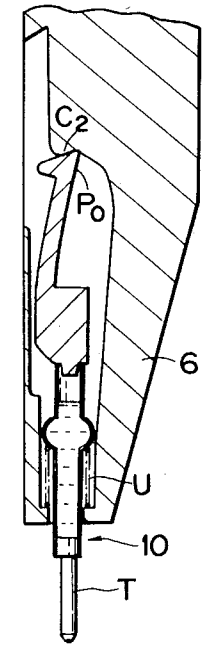
FIGS. 6*a* and 6*b* are sections of the foot member taken along the line 6—6 of FIG. 5.
Figure 6A:
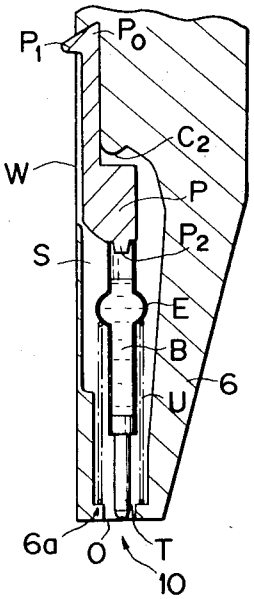

Referring to FIG. 6*a*, ball-point pen 10 consists of tip T and ink tube B. Cam piece P has a lower projection $P_2$, of the shape shown in FIG. 7, which fits firmly into the top end of the ink tube B. Spring U is provided between an expanded portion E of ink tube B, formed in the vicinity of the top of the ink tube B, and a stepped portion 6*a* formed on the inner side of opening O of foot member 6. The tip, body and spring are conventional, thus, a further description thereof will be omitted.

In order to assemble the ball-point pen 10 in the foot member 6, the members P, B, U, are assembled first, and the resulting assembly is forced into a foot member 6 through an opening W and pressed downward. Consequently, the ball-point pen is placed in the position shown in FIG. 6*a*.

Cam piece P has an acute-angled portion $P_0$ at the upper end thereof, a front projection $P_1$ and a lower locking projection $P_2$ (discussed above) which fits into the top of the ink tube B. In this embodiment of the invention, cam piece P is made of an elastic material, such as a plastic.

In order to employ school utensil and toy robot 1 as a writing instrument or as a compass, ball-point pen 10 must be in the extended position shown in FIG. 6*b*. To get ball-point pen 10 from the retracted position (shown in FIG. 6*a*) to the extended position, the following steps are taken. First, front projection $P_1$ is pressed down with the fingertip or nail. As a result, the cam piece P and ball-point pen 10 are lowered against the force of the spring U, so that the ball-point pen 10 projects from the lower surface of the foot member 6. Cam piece P is pressed down until the acute-angled portion $P_0$ at the upper end of the cam piece P moves past the cam $C_2$ (the cam piece P bends slightly due to its own elasticity) to be positioned behind the cam $C_2$. When the finger or nail is then removed from the projection $P_1$, the cam piece P is forced upward by the spring U and portion $P_0$ engages cam $C_2$. Therefore, the acute-angled portion $P_0$ engages the rear surface of the cam $C_2$ reliably, as shown in FIG. 6*b*, so that the ball-point pen is ready for use.

To retract the ball-point pen 10 into the interior of the foot member 6 once ball-point pen 10 has been extended, the tip T of the ball-point pen is held by the fingers and pulled down slightly. As a result, the cam piece P returns to its original shape, i.e the substantially linear shape shown in FIG. 6*a*, by its own elasticity. When the tip T is then released, the ball-point pen 10 returns to the position shown in FIG. 6*a* due to the force of the spring U, and is housed in the interior of the foot member 6. If ball-point pen 10 is designed such that tip T projects from the lower surface of the foot member 6 by at least 8 mm, tip T can be held easily by the fingers of the user.

When the ball-point pens are constructed as described above, they can be retractably housed in foot members of extremely small dimensions.

The two ball-point pens 10 of a single school utensil and toy robot 1 may contain ink of the same color or of different colors. When the ball-point pens contain ink of the same color, it is unnecessary to worry about running out of ink. When the ball-point pens contain inks of different colors, this invention can be used as a two-color ball-point pen.

This embodiment is provided with ball-point pens 10 at the lower ends of foot members 6. One of these ball-point pens 10 may be replaced with a pointer. When both of the ball-point pens 10 are replaced with pointers, the toy robot can be used as a divider.

Furthermore, the toy features of the school utensil do not have to be the features of a toy robot. The features could depict a human being, a fictional storybook, fairy tale, or TV character, etc. The toy would then function as a doll of such a person or fictional character. "Robotomorphic" for the purpose of this application is defined as robot-like features, not in the context of a conventional, industrial, production-line, robot but rather, features conveying the overall concept of a toy robot involving the bipedal anthropoids of fiction.

Also, in some embodiments of this invention, foot members 6 can be omitted and ball-point pens 10 located in the bottom portions of leg members 5.

Other improvements, modifications and embodiments will become apparent to one of ordinary skill in the art upon review of this disclosure. Such improvements, modifications and embodiments are considered to be within the scope of this invention as defined by the following claims.

I claim:

1. A school utensil and toy robot comprising a support constituting a nucleus of a robot body having aesthetically pleasing features to a child, said support including a base portion and a rod portion extending upward from said base portion; a head means fixed onto the upper end of said rod portion; a trunk means joined to said rod portion of said support so as to surround the same in discrete relationship thereto; a pair of arm members joined to said trunk member; a shaft provided in said base portion of said support so as to extend perpendicular thereto; at least two leg members fitted by their upper end portions around said shaft; foot members having at least one flat surface, one foot member being movably attached to the bottom of each leg member; means for writing provided in at least one of the foot members; wherein said head, trunk, arm and foot members complement one another so as to be capable of simulating a toy robot and wherein said foot members are arrangeable with said flat surfaces against a generally level supporting surface to support the utensil and toy in a freestanding position.

2. A school utensil and toy robot according to claim 24, wherein said base portion of said support comprises front and rear parallel vertical plates and a horizontal plate connecting the upper ends of said two vertical plates, said rod portion being supported on the upper surface of said horizontal plate, and said shaft being fixedly provided between said vertical plates.

3. A school utensil and toy robot according to claim 2, wherein said trunk member comprises right and left matching members which have annular portions formed one above the other and fitted around said rod portion, said right and left matching members, except for said annular portions, being formed symmetrically with each other, and said two arm members being joined matching members.

4. A school utensil and toy robot as claimed in claim 1 wherein said two leg members are provided with a means for restricting the opening and closing thereof, said restriction means being capable of sliding along said two leg members when said leg members are in abutment.

5. A school utensil and toy robot as claimed in claim 1, wherein said writing means comprises at least one of said foot members, said one foot member having an internal space open at the front and bottom surfaces thereof, and a ball-point pen housed at least partially in said internal space.

6. A school utensil and toy robot as claimed in claim 5, wherein said foot members are connected to their respective leg members in such a manner that each said foot member can move pivotally between a first and a second position with respect to its leg member about a laterally-extending pin whereby the foot members support the utensil and toy in a freestanding position when said foot members are in said second position and the writing means is actuable when said foot members are in the first position.

7. A school utensil and toy robot as claimed in claim 5, wherein said ball-point pen comprises an ink tube, a tip joined to the lower end of said ink tube, a spring provided between said ink tube and the inner surface of said opening at the lower end of said one foot member, and a cam piece provided at the upper end of said ink tube, said ball-point pen being housed in said internal space in said foot member in such a manner that said ball-point pen can project downward from said opening at the lower end thereof.

8. A school utensil and toy robot as claimed in claim 7, wherein said ball-point pen has at least two positions, a retracted position and an extended position, wherein said cam piece projects partially from said opening of said internal space at the front surface of said one foot member when said ball-point pen is in said retracted position, said cam piece as a whole being housed in said internal space when said ball-point pen is in said extended position.

9. A toy robot usable as a school utensil as claimed in claim 7, wherein the length of said tip of said ball-point pen, which projects to the outside of said one foot member when said ball-point pen is set ready for use, is at least 8 mm.

10. A school utensil and toy comprising:

a support member including a base member and a rod, said rod extending outward from said base member;

two elongated leg members rotatably connected to said support member, said leg members being free to rotate relative to each other;

foot members rotatably connected to said leg members said foot members each having at least one flat surface arrangeable to support the school utensil and toy robot on a relatively level surface in a freestanding position;

at least one of said foot members including means for writing; and first members which include a pair of arm members rotatably connected to said rod, an annular portion abutting said rod and an extended portion in the shape of an arm extending outward from said annular portion, said first members further defining a head mounted at one end of said rod, the first members having features aesthetically pleasing to children, said first members defining robotomorphic features capable of cooperating to simulate a toy robot;

said first members being attached to said support members.

11. A school utensil and toy comprising:

a support member;

two elongated leg members rotatably connected to said support member, said leg members being free to rotate relative to each other;

foot members rotatably connected to said leg members said foot members each having at least one flat surface arrangeable to support the school utensil and toy robot on a relatively level surface in a freestanding position;

at least one of said foot members including means for writing;

first members having features aesthetically pleasing to children, said first members defining anthropomorphic features capable of cooperating to simulate a toy robot;

said first members being attached to said support members; and restriction means slidably mounted on said leg members;

said restriction means being slidable between at least two positions with respect to said leg members comprising a locking position wherein said restriction means prevents said leg members from rotating relative to each other and an open position wherein said restriction means does not restrict the relative movement of the leg members.

12. A school utensil and toy as claimed in claim 11 wherein each of said leg members has a projection extending therefrom, said restriction means engaging said projection when said restriction means is in said locking position.

13. A school utensil and toy according to claim 12 wherein said restriction member engages said support means when said locking means is in said open position.

14. A school utensil and toy comprising: a support member;

two-elongated leg members rotatably connected to said support member, said leg members free to rotate relative to each other;

foot members rotatably connected to said leg members said foot members each having at least one flat surface arrangeable to support the school utensil and toy robot on a relatively level surface in a freestanding position;

at least one of said foot members including means for writing wherein said foot members are each rotatable between at least two positions, a first position wherein said foot members are positioned such that said writing means extends in a direction longitudinal of said leg members, and a second position wherein said flat surfaces are positioned as bottom surfaces approximately perpendicular to the elongated direction of the leg members; and first members having features aesthetically pleasing to children, said first members defining anthropomorphic features capable of cooperating to simulate a toy robot;

said first members being attached to said support members.

15. A school utensil and toy as claimed in claim 14 wherein said bottom surfaces of said foot members are designed and arranged to support said school utensil and toy in a freestanding position when said foot members are in said second position.

* * * * *